US008943987B2

(12) United States Patent
Jones et al.

(10) Patent No.: US 8,943,987 B2
(45) Date of Patent: Feb. 3, 2015

(54) SWING AWAY HELM FOR WATERCRAFT

(71) Applicants: Bartley D. Jones, Mound, MN (US); Steven R. Hendrickson, Burnsville, MN (US)

(72) Inventors: Bartley D. Jones, Mound, MN (US); Steven R. Hendrickson, Burnsville, MN (US)

( * ) Notice: Subject to any disclaimer, the term of this patent is extended or adjusted under 35 U.S.C. 154(b) by 94 days.

(21) Appl. No.: 13/743,416

(22) Filed: Jan. 17, 2013

(65) Prior Publication Data

US 2013/0186321 A1 Jul. 25, 2013

Related U.S. Application Data

(60) Provisional application No. 61/588,845, filed on Jan. 20, 2012.

(51) Int. Cl.

| | |
|---|---|
| ***B63H 25/10*** | (2006.01) |
| ***B63H 25/02*** | (2006.01) |
| ***B63H 5/16*** | (2006.01) |

(52) U.S. Cl.

CPC ..... *B63H 25/02* (2013.01); *B63H 5/165* (2013.01); *B63H 2025/022* (2013.01)

USPC ..... 114/144 R

(58) Field of Classification Search

CPC .. B63H 21/213; B63H 2025/022; B62D 1/18; B62D 1/184; E02F 9/2004; E02F 9/16; B60K 35/00; G05G 1/085

USPC ..... 440/84, 87; 114/144 R, 144 RE; 74/493

See application file for complete search history.

(56) References Cited

U.S. PATENT DOCUMENTS

| | | | | |
|---|---|---|---|---|
| 2,629,356 | A | 2/1953 | Whiting | |
| 4,085,697 | A | 4/1978 | Gaasenbeek | |
| 4,299,407 | A * | 11/1981 | Simson | 280/775 |
| 4,733,745 | A | 3/1988 | Lumpkins | |
| 4,739,236 | A | 4/1988 | Burkenpas | |
| 4,821,837 | A | 4/1989 | Fifer | |
| 5,048,444 | A | 9/1991 | Moore | |
| 5,337,692 | A | 8/1994 | Troiani | |
| 5,372,082 | A | 12/1994 | Hattori | |
| 5,465,679 | A | 11/1995 | Mardikian | |
| 5,632,353 | A | 5/1997 | Kimberley | |
| 5,881,665 | A | 3/1999 | Ratcliff | |
| 5,943,979 | A | 8/1999 | Hattori | |
| 6,062,154 | A | 5/2000 | Ito | |
| 6,202,583 | B1 | 3/2001 | Asakura | |
| 6,834,606 | B2 | 12/2004 | Berret et al. | |
| 7,258,072 | B2 | 8/2007 | Wong et al. | |
| 7,490,571 | B2 * | 2/2009 | Luxford | 114/144 R |
| 8,037,781 | B2 | 10/2011 | Curtin et al. | |
| 2005/0263976 | A1 | 12/2005 | Brockway | |
| 2008/0105182 | A1 | 5/2008 | Luxford | |

* cited by examiner

*Primary Examiner* — S. Joseph Morano
*Assistant Examiner* — Andrew Polay
(74) *Attorney, Agent, or Firm* — Mitchell A. Rossman; Terra Nova Patent Law, PLLC

(57) ABSTRACT

The present invention provides swing away helm for a watercraft. The swing away helm is positionable between a use position in which the swing away helm extends into the watercraft and a non-use position in which the swing away helm is positioned above a gunnel of the watercraft. The swing away helm includes; a mounting member, a support member, a dashboard, a steering device, and a biasing member. The swing away helm maintains an equal distance from the gunnel in the use position and in the non-use position.

4 Claims, 11 Drawing Sheets

SWING AWAY HELM FOR WATERCRAFT

RELATED APPLICATIONS

This application claims priority to U.S. Provisional Patent Application Ser. No. 61/588,845 filed Jan. 20, 2012, which is hereby incorporated by reference in its entirety for all purposes.

BACKGROUND OF THE INVENTION

Many small watercrafts typically have a steering arrangement or helm that includes a steering wheel mounted to a dashboard, which is placed in the center or to one side of the interior space in the watercraft. As a consequence, the helm is either mounted within the boat or extends into the boat and takes up a large amount of space. Further, there are times, for example, being anchored at a fishing spot, where the helm is not required. However, it is generally not possible or convenient to remove the helm when not in use.

What is needed is a helm that may swing out of the boat space when not in use.

SUMMARY OF THE INVENTION

The present invention provides a swing away helm that extends into the interior space when the helm is in use but swings away above one of the gunnels when the helm is not in use. This swing away helm allows for the full use of the interior space of the boat when the helm is not in use, but is conveniently swung down into position in the interior of the boat before using. The swing away helm is simple to manufacture and install.

The present invention provides a swing away helm for a watercraft that is positionable between a use position in which the swing away helm extends into the watercraft and a non-use position in which the swing away helm is positioned above a gunnel of the watercraft. The swing away helm includes: a mounting member having an interior surface and an exterior surface, wherein the exterior surface of the mounting member is coupled to a first surface on a starboard or a port side of a deck having a first surface and a second surface; a support member having a proximal end and a distal end, wherein the proximal end of the support member is pivotally attached to the mounting member for pivotal movement about a substantially horizontal axis relative to the gunnel of the watercraft; a dashboard having a first surface and a second surface, wherein the dashboard is coupled to the distal end of the support member; a steering device operatively coupled to the first surface of the dashboard; a optional biasing member having a proximal end and a distal end, wherein the proximal end of the optional biasing member is coupled to the distal end of the support member and distal end of the optional biasing member is coupled to the interior surface of the mounting member, wherein the optional biasing member biases the swing away helm into the use position and the non-use position, and wherein the swing away helm maintains an equal distance from the gunnel in the use position and in the non-use position.

In one embodiment, the deck includes a molded cockpit. In one embodiment, the swing away helm extends into the molded cockpit when in the use position. In one embodiment, the mounting member includes a pivot member and a motion limiting member. In one embodiment, the pivot member allows the support member to pivot about a substantially horizontal axis relative to the gunnel of the watercraft. In one embodiment, the motion limiting member prevents the swing away helm from swinging past the use position by blocking the movement of the support member. In one embodiment, the interior surface of the mounting member prevents the swing away helm from swinging past the non-use position by blocking the movement of the support member.

In one embodiment, the steering device includes a steering wheel. In one embodiment, the optional biasing member includes a gas strut.

The present invention provides a swing away helm for a watercraft that is positionable between a use position in which the swing away helm extends into the watercraft and a non-use position in which the swing away helm is positioned above a gunnel of the watercraft. The swing away helm includes: a mounting member having an interior surface and an exterior surface, wherein the mounting member includes a pivot member and a motion limiting member, wherein the exterior surface of the mounting member is coupled to a first surface on a starboard or a port side of a molded deck having a first surface and a second surface; a support member having a proximal end and a distal end, wherein the proximal end of the support member is pivotally attached to the pivot member for pivotal movement about a substantially horizontal axis relative to the gunnel of the watercraft, wherein the motion limiting member prevents the swing away helm from swinging past the use position by blocking the movement of the support member, wherein the interior surface of the mounting member prevents the swing away helm from swinging past the non-use position by blocking the movement of the support member; a dashboard having a first surface and a second surface, wherein the dashboard is coupled to the distal end of the support member; a steering device operatively coupled to the first surface of the dashboard, wherein the steering device includes a steering wheel; a biasing member having a proximal end and a distal end, wherein the proximal end of the biasing member is coupled to the distal end of the support member and distal end of the biasing member is coupled to the interior surface of the mounting member, wherein the biasing member biases the swing away helm into the use position and the non-use position, wherein the biasing member includes a gas strut, and wherein the swing away helm maintains an equal distance from the gunnel in the use position and in the non-use position.

The present invention provides a swing away helm for a watercraft that is positionable between a use position in which the swing away helm extends into a cockpit and a non-use position in which the swing away helm is positioned above a gunnel of the watercraft. The swing away helm includes: a mounting member having an interior surface and an exterior surface, wherein the mounting member includes a pivot member and a motion limiting member, wherein the exterior surface of the mounting member is coupled to a first surface on a starboard or a port side of a molded deck having a first surface and a second surface; a support member having a proximal end and a distal end, wherein the proximal end of the support member is pivotally attached to the pivot member for pivotal movement about a substantially horizontal axis relative to the gunnel of the watercraft, wherein the motion limiting member prevents the swing away helm from swinging past the use position by blocking the movement of the support member, wherein the interior surface of the mounting member prevents the swing away helm from swinging past the non-use position by blocking the movement of the support member; a dashboard having a first surface and a second surface, wherein the dashboard is coupled to the distal end of the support member; a steering device operatively coupled to the first surface of the dashboard, wherein the steering device includes a steering wheel; a biasing member having a proximal end and a distal end, wherein the proximal end of the biasing member is coupled to the distal end of the support member and distal end of the biasing member is coupled to the interior surface of the mounting member, wherein the biasing member biases the swing away helm into the use position and the non-use position, wherein the biasing member includes a gas strut, and wherein the swing away helm maintains an equal distance from the gunnel in the use position and in the non-use position.

BRIEF DESCRIPTION OF THE DRAWINGS

Embodiments of the invention may be best understood by referring to the following description and accompanying drawings, which illustrate such embodiments. In the drawings.

Figure 1:
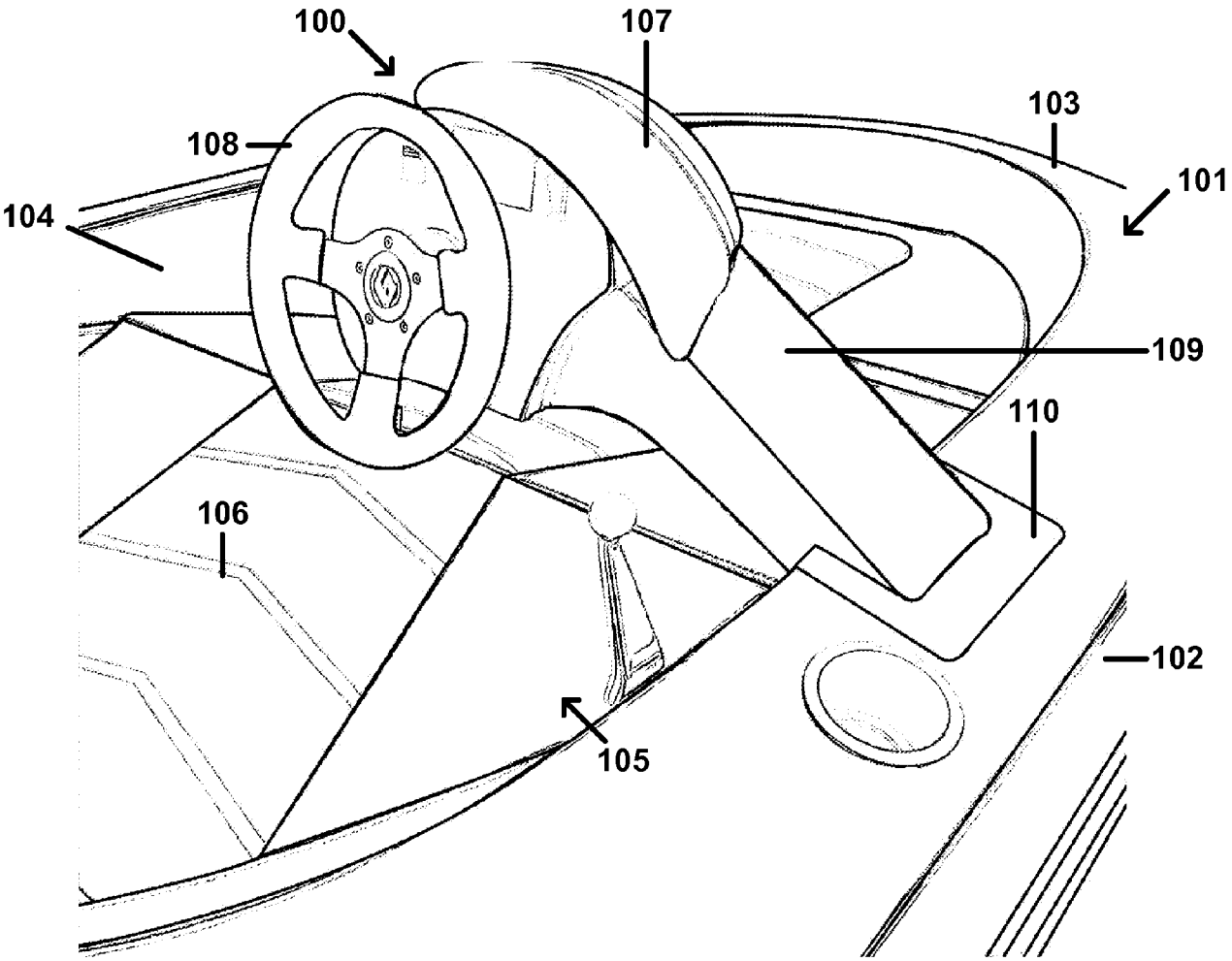
FIG. 1 is a perspective side-view drawing illustrating an exemplary swing away helm in a watercraft in the use position.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a swing away helm that extends into the interior space when the helm is in use but swings away above one of the gunnels when the helm is not in use. This swing away helm allows for the full use of the interior space of the boat when the helm is not in use, but is conveniently swung down into position in the interior of the boat before using. The swing away helm is simple to manufacture and install.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "cockpit" refers to the space on the deck where the user operates the helm.

As used herein, the term "deck" refers to the floor of a watercraft, especially the upper, open level extending for the full length of the vessel. The deck may be a one-piece molded construction.

As used herein, the phrase "operatively coupled" refers to bringing two or more items together or into relationship with each other such that they may operate together or allow transfer of information between the two or more items.

As used herein, the term "gunnel" refers to the top edge of the side of the watercraft.

As used herein, the term "helm" refers to the steering mechanism of the watercraft.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

As used herein, the phrase "turnable propeller assembly" refers to a propeller assembly in which a propeller in a horizontal plane. The assembly is mounted so that it can be turned around a vertical axis for steering a vessel, being located beneath, behind, at the bows, or to one or both sides of the vessel.

As used herein, the term "watercraft" refers to a vessel for transport by water, constructed to provide buoyancy by excluding water and shaped to give stability and to allow propulsion. Also as used herein, the watercraft may include a molded hull and a molded deck. The molded deck may include a molded cockpit.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

FIG. 1 is a perspective side-view drawing illustrating an exemplary swing away helm 100 in a watercraft 101 in the use position. The watercraft includes a hull 102, a bow 103, a deck 104, and a cockpit 105. In this view, the swing away helm 100 is in the use position and extends into the cockpit 105, where it can be operated by the user (not shown) in the seat 106. The swing away helm 100 includes a dashboard 107, a steering wheel 108, and a support member 109 that extends from the gunnel 110.

Figure 2:
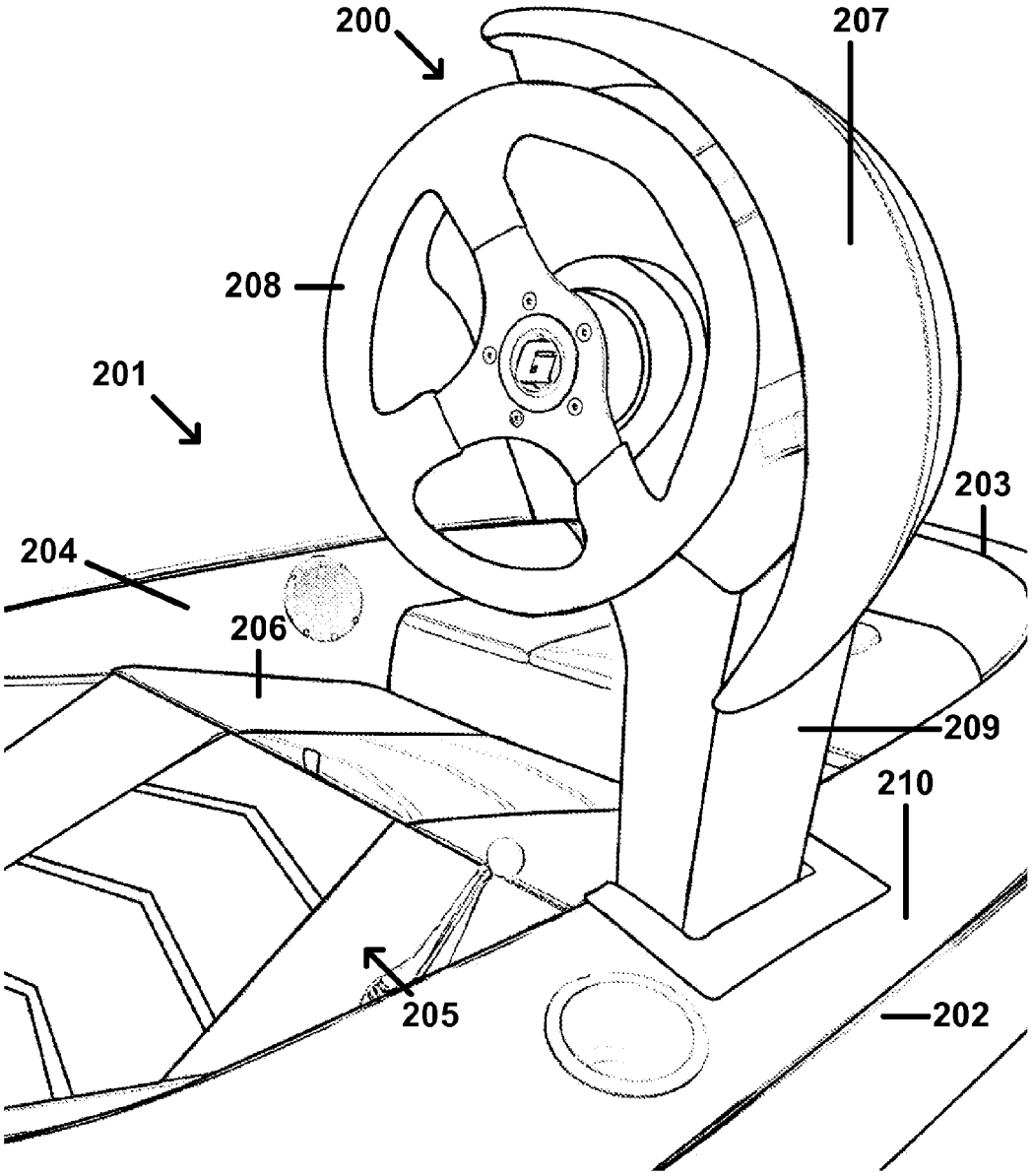
FIG. 2 is a perspective side-view drawing illustrating an exemplary swing away helm in a watercraft in the non-use position.

FIG. 2 is a perspective side-view drawing illustrating an exemplary swing away helm 200 in a watercraft 201 in the non-use position. The watercraft includes a hull 202, a bow 203, a deck 204, and a cockpit 205 where the user (not shown) typically sits on the seat 206. The swing away helm 200 includes a dashboard 207, a steering wheel 208, and a support member 209 that extends above the gunnel 210.

Figure 3:
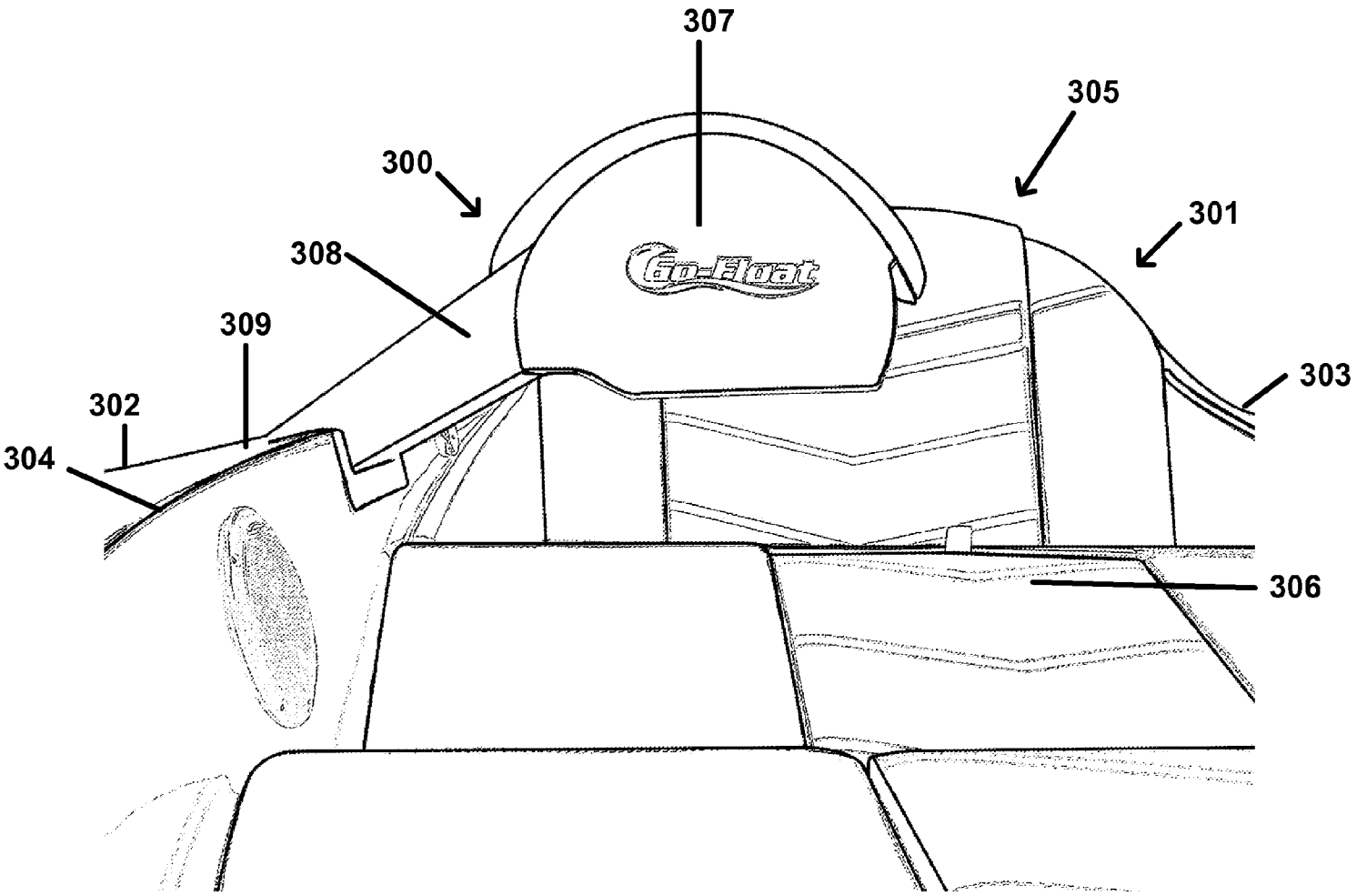
FIG. 3 is a front-view drawing illustrating an exemplary swing away helm in a watercraft in the use position.

FIG. 3 is a front-view drawing illustrating an exemplary swing away helm 300 in a watercraft 301 in the use position. The watercraft includes a hull 302, a stern 303, a deck 304, and a cockpit 305. In this view, the swing away helm 300 is in the use position and extends into the cockpit 305, where it can be operated by the user (not shown) in the seat 306. The swing away helm 300 includes a dashboard 307, a steering wheel (not shown), and a support member 308 that extends from the gunnel 309.

Figure 4:
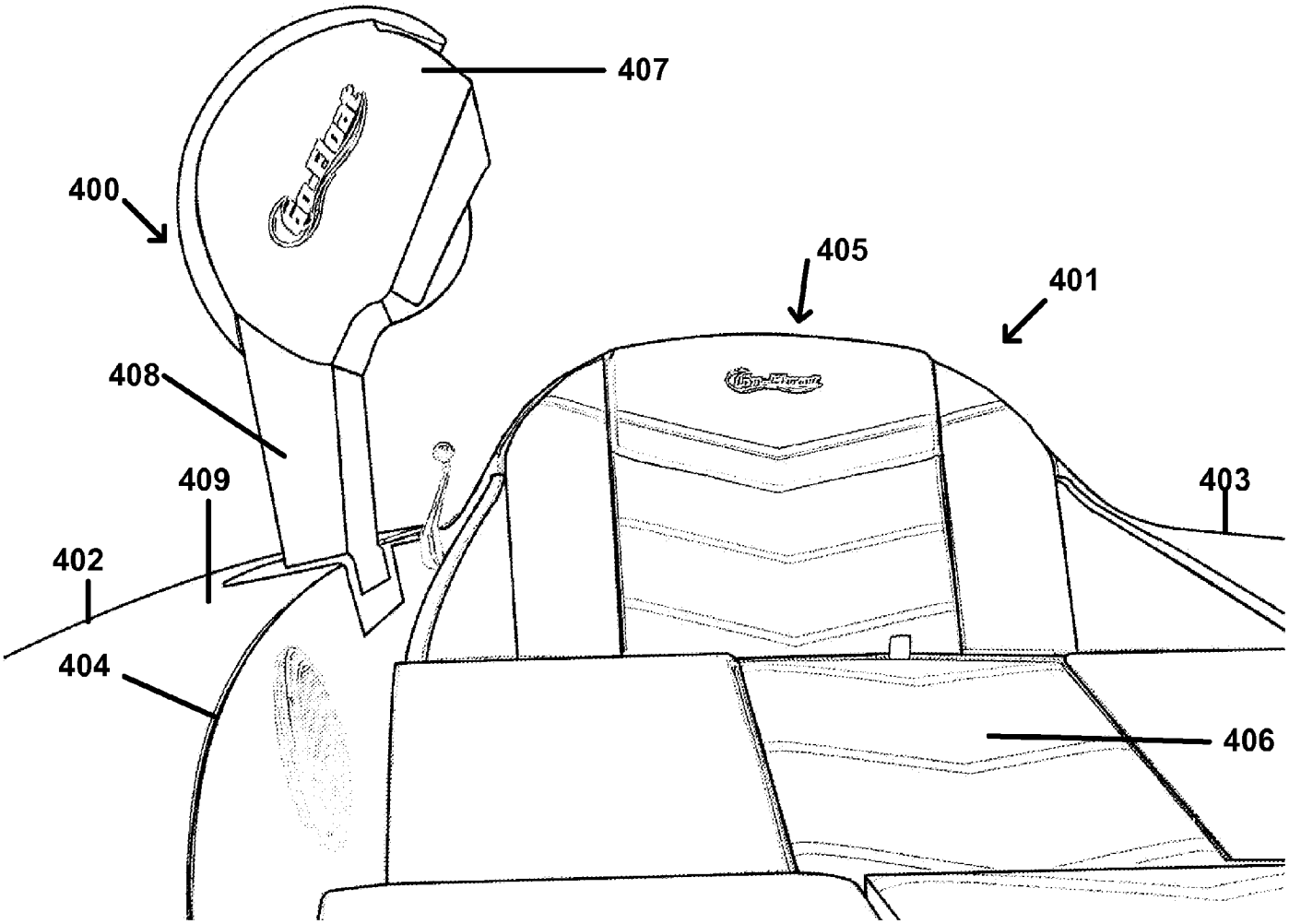
FIG. 4 is a perspective front-view drawing illustrating an exemplary swing away helm in a watercraft in the non-use position.

FIG. 4 is a front-view drawing illustrating an exemplary swing away helm 400 in a watercraft 401 in the non-use position. The watercraft includes a hull 402, a stern 403, a deck 404, and a cockpit 405 where the user (not shown) typically sits on the seat 406. The swing away helm 400 includes a dashboard 407, a steering wheel (not shown), and a support member 408 that extends from the gunnel 409.

Figure 5:
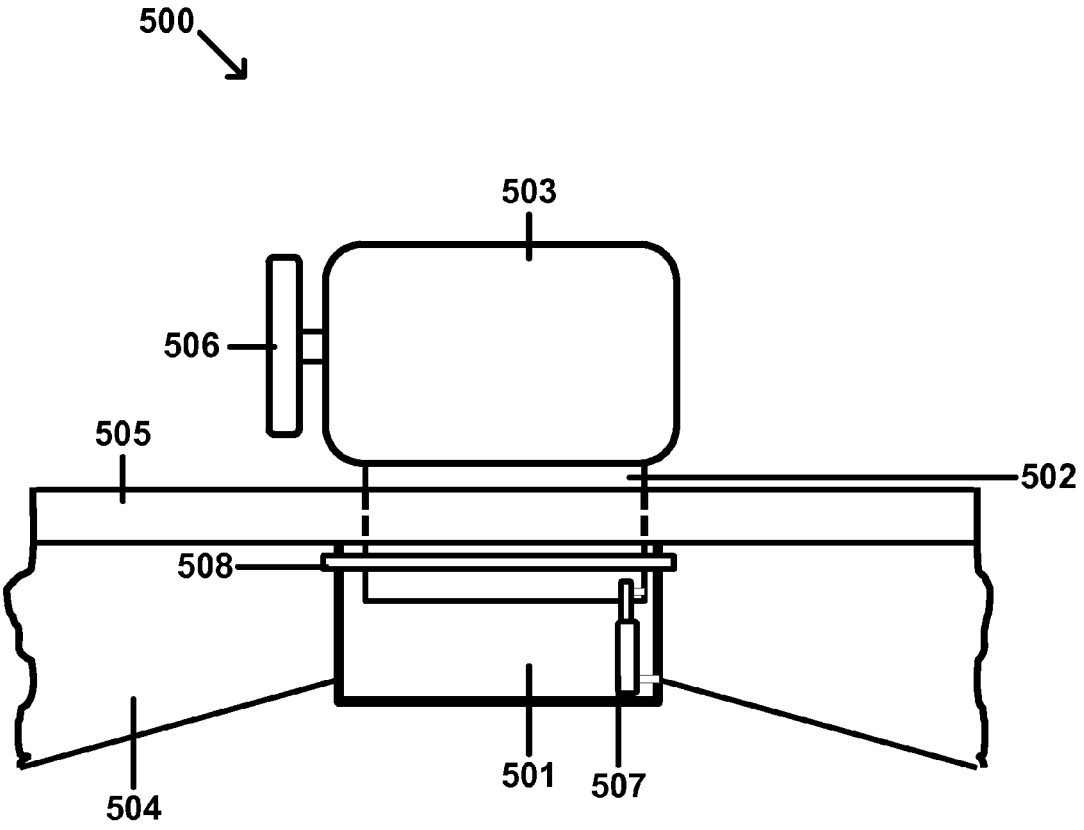
FIG. 5 is a side-view drawing illustrating an exemplary swing away helm in a watercraft in the use position.

FIG. 5 is a side-view drawing illustrating an exemplary swing away helm 500 in a watercraft in the use position. The swing away helm 500 includes a mounting member 501, a support member 502, and a dashboard 503. The mounting member 501 is attached to the exterior side of the molded deck 504 of the watercraft. The molded deck 504 also includes a gunnel 505. The support member 502 has a proximal end, which fits into the mounting bracket 501 and a distal end, which is coupled to the dashboard 503. The support member 503 is pivotally attached to the mounting member 501 for pivotal movement about a substantially horizontal axis relative to the gunnel 505 of the watercraft. The dashboard 503 includes a steering device 506. The wiring connecting the dashboard 503 with the rest of the watercraft is not shown. The biasing member 507 is attached to the proximal end of the support member 502 and to the interior surface of the mounting member 501. The dashboard 503 and the support member 502 can swing relative to the mounting member 501 between a use position where the dashboard 503 extends into the watercraft and a non-use position (not shown) where the dashboard 503 is positioned above the gunnel 505. The biasing member 507 biases the swing away helm 500 into the use position and the non-use position (not shown). The mounting member 501 also included a pivoting member (not shown) and a motion limiting member 508. The pivoting member (not shown) allows the support member 502 to pivot about a substantially horizontal axis relative to the gunnel 505. The motion limiting member 508 prevents the swing away helm 500 from swinging past the use position by blocking the upward pivoting movement of the proximal end of the support member 502 about the pivoting member (not shown).

Figure 6:
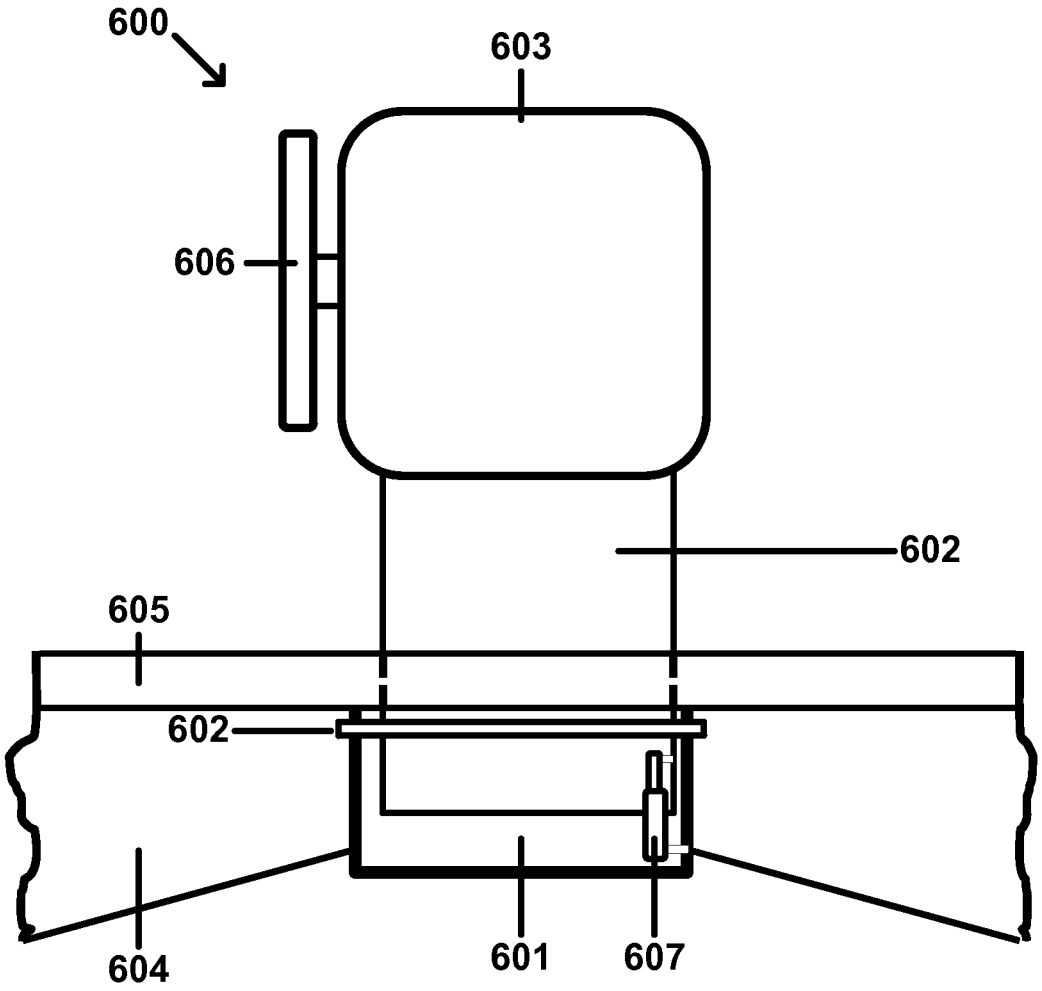
FIG. 6 is a side-view drawing illustrating an exemplary swing away helm in a watercraft in the non-use position.

FIG. 6 is a side-view drawing illustrating an exemplary swing away helm 600 in a watercraft in the non-use position. The swing away helm 600 includes a mounting member 601, a support member 602, and a dashboard 603. The mounting member 601 is attached to the exterior side of the molded deck 604 of the watercraft. The molded deck 604 also includes a gunnel 605. The support member 602 has a proximal end, which fits into the mounting bracket 601 and a distal end, which is coupled to the dashboard 603. The support member 603 is pivotally attached to the mounting member 601 for pivotal movement about a substantially horizontal axis relative to the gunnel 605 of the watercraft. The dashboard 603 includes a steering device 606. The wiring connecting the dashboard 603 with the rest of the watercraft is not shown. The biasing member 607 is attached to the proximal end of the support member 602 and to the interior surface of the mounting member 601. The dashboard 603 and the support member 602 can swing relative to the mounting member 601 between a use position (not shown) where the dashboard 603 extends into the watercraft (not shown) and a non-use position where the dashboard 603 is positioned above the gunnel 605. The biasing member 607 biases the swing away helm 600 into the use position (not shown) and the non-use position. The mounting member 601 also included a pivoting member (not shown) and a motion limiting member 608. The pivoting member (not shown) allows the support member 602 to pivot about a substantially horizontal axis relative to the gunnel 605. The motion limiting member 608 prevents the swing away helm 600 from swinging past the use position (not shown) by blocking the upward pivoting movement of the proximal end of the support member 602 about the pivoting member (not shown).

Figure 7:
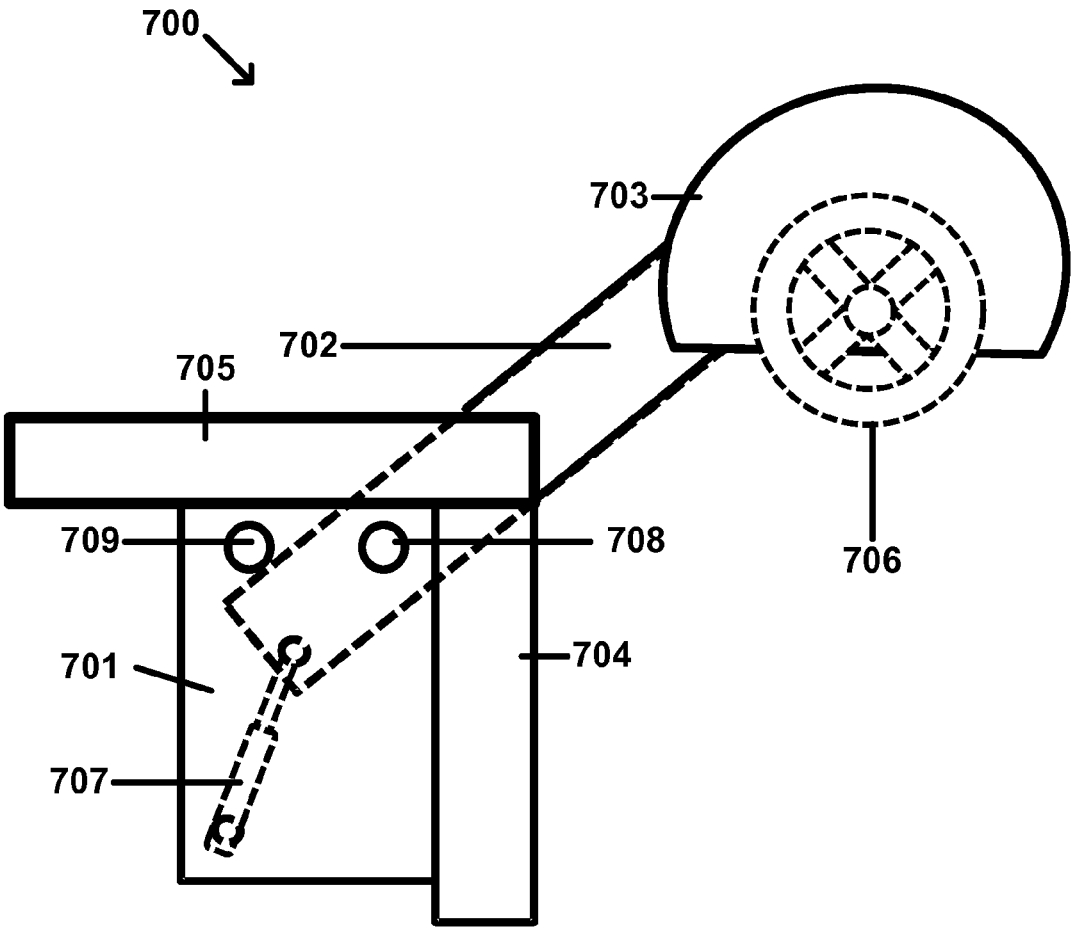
FIG. 7 is a front-view drawing illustrating an exemplary swing away helm in a watercraft in the use position.

FIG. 7 is a front-view drawing illustrating an exemplary swing away helm 700 in a watercraft in the use position. The swing away helm 700 includes a mounting member 701, a support member 702, and a dashboard 703. The mounting member 701 is attached to the exterior side of the molded deck 704 of the watercraft. The molded deck 704 also includes a gunnel 705. The support member 703 has a proximal end, which fits into the mounting bracket 701 and a distal end, which is coupled to the dashboard 703. The support member 702 is pivotally attached to the mounting member 701 for pivotal movement about a substantially horizontal axis relative to the gunnel 705 of the watercraft. The dashboard 703 includes a steering device 706. The wiring connecting the dashboard 703 with the rest of the watercraft is not shown. The biasing member 707 is attached to the proximal end of the support member 702 and to the interior surface of the mounting member 701. The dashboard 703 and the support member 702 can swing relative to the mounting member 701 between a use position where the dashboard 703 extends into the watercraft and a non-use position (not shown) where the dashboard 703 is positioned above the gunnel 705. The biasing member 707 biases the swing away helm 700 into the use position and the non-use position (not shown). The mounting member 701 also included a pivoting member 708 and a motion limiting member 709. The pivoting member 708 allows the support member 702 to pivot about a substantially horizontal axis relative to the gunnel 705. The motion limiting member 709 prevents the swing away helm 700 from swinging past the use position by blocking the upward pivoting movement of the proximal end of the support member 702 about the pivoting member 708.

Figure 8:
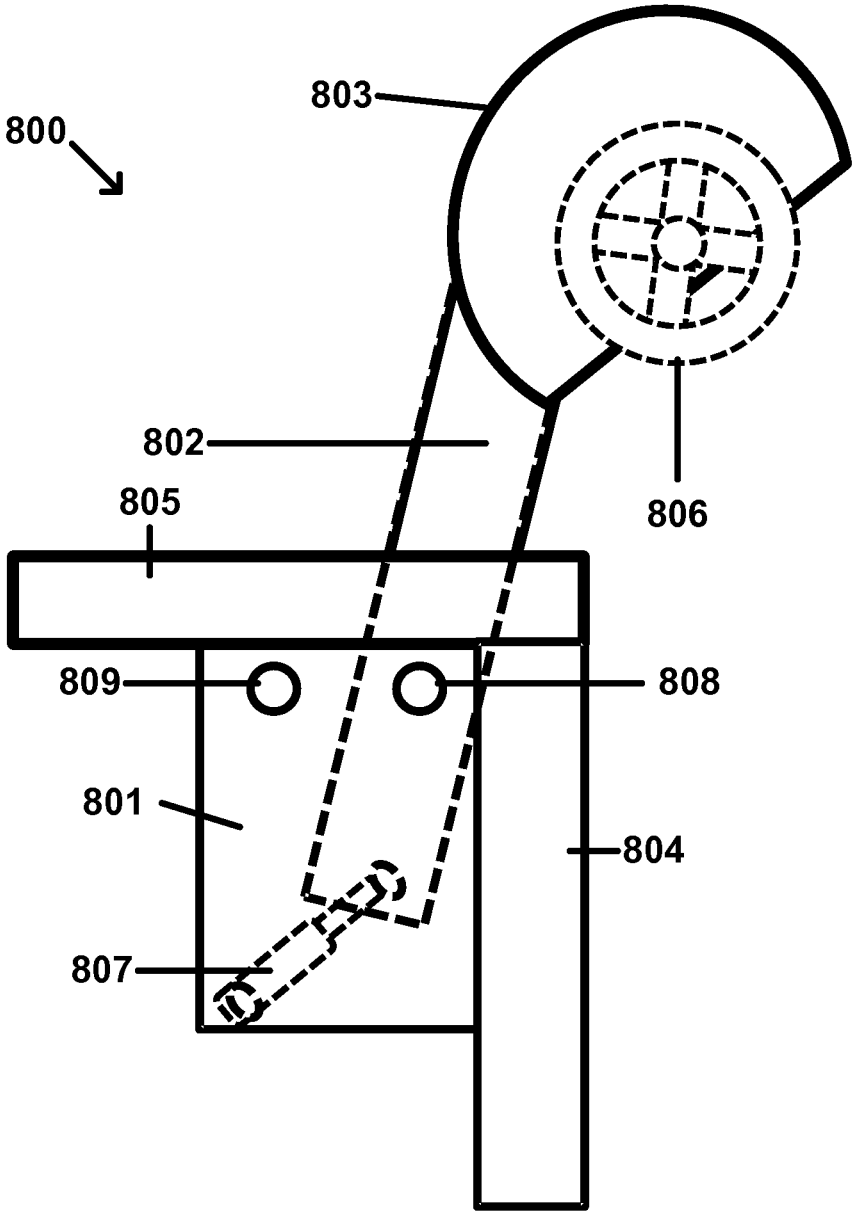
FIG. 8 is a front-view drawing illustrating an exemplary swing away helm in a watercraft in the non-use position.

FIG. 8 is a front-view drawing illustrating an exemplary swing away helm 800 in a watercraft in the non-use position. The swing away helm 800 includes a mounting member 801, a support member 802, and a dashboard 803. The mounting member 801 is attached to the exterior side of the molded deck 804 of the watercraft. The molded deck 804 also includes a gunnel 805. The support member 803 has a proximal end, which fits into the mounting bracket 801 and a distal end, which is coupled to the dashboard 803. The support member 802 is pivotally attached to the mounting member 801 for pivotal movement about a substantially horizontal axis relative to the gunnel 805 of the watercraft. The dashboard 803 includes a steering device 806. The wiring connecting the dashboard 803 with the rest of the watercraft is not shown. The biasing member 807 is attached to the proximal end of the support member 802 and to the interior surface of the mounting member 801. The dashboard 803 and the support member 802 can swing relative to the mounting member 801 between a use position (not shown) where the dashboard 803 extends into the watercraft (not shown) and a non-use position where the dashboard 803 is positioned above the gunnel 805. The biasing member 807 biases the swing away helm 800 into the use position (not shown) and the non-use position. The mounting member 801 also included a pivoting member 808 and a motion limiting member 809. The pivoting member 808 allows the support member 802 to pivot about a substantially horizontal axis relative to the gunnel 805. The motion limiting member 809 prevents the swing away helm 800 from swinging past the use position (not shown) by blocking the upward pivoting movement of the proximal end of the support member 802 about the pivoting member 808.

Figure 9:
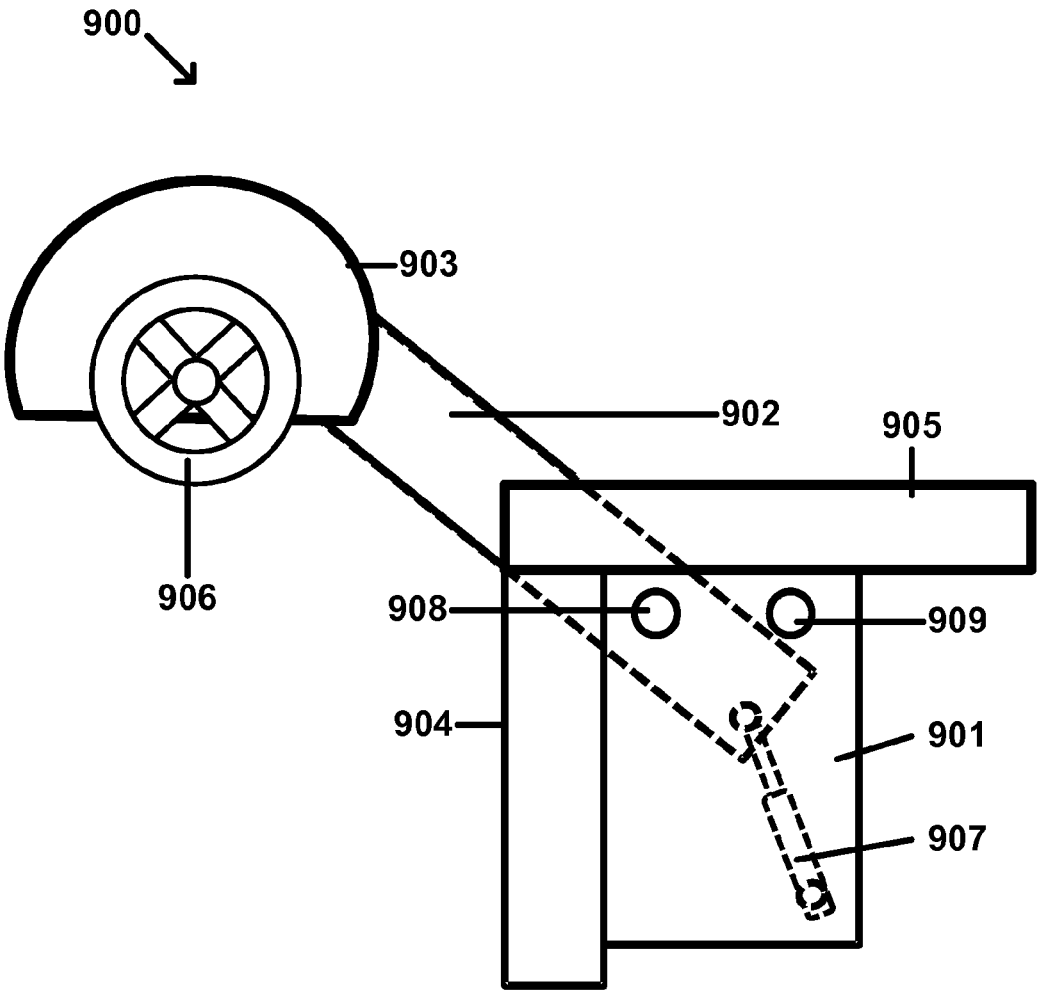
FIG. 9 is a rear-view drawing illustrating an exemplary swing away helm in a watercraft in the use position.

FIG. 9 is a rear-view drawing illustrating an exemplary swing away helm 900 in a watercraft in the use position. The swing away helm 900 includes a mounting member 901, a support member 902, and a dashboard 903. The mounting member 901 is attached to the exterior side of the molded deck 904 of the watercraft. The molded deck 904 also includes a gunnel 905. The support member 903 has a proximal end, which fits into the mounting bracket 901 and a distal end, which is coupled to the dashboard 903. The support member 902 is pivotally attached to the mounting member 901 for pivotal movement about a substantially horizontal axis relative to the gunnel 905 of the watercraft. The dashboard 903 includes a steering device 906. The wiring connecting the dashboard 903 with the rest of the watercraft is not shown. The biasing member 907 is attached to the proximal end of the support member 902 and to the interior surface of the mounting member 901. The dashboard 903 and the support member 902 can swing relative to the mounting member 901 between a use position where the dashboard 903 extends into the watercraft and a non-use position (not shown) where the dashboard 903 is positioned above the gunnel 905. The biasing member 907 biases the swing away helm 900 into the use position and the non-use position (not shown). The mounting member 901 also included a pivoting member 908 and a motion limiting member 909. The pivoting member 908 allows the support member 902 to pivot about a substantially horizontal axis relative to the gunnel 905. The motion limiting member 909 prevents the swing away helm 900 from swinging past the use position by blocking the upward pivoting movement of the proximal end of the support member 902 about the pivoting member 908.

Figure 10:
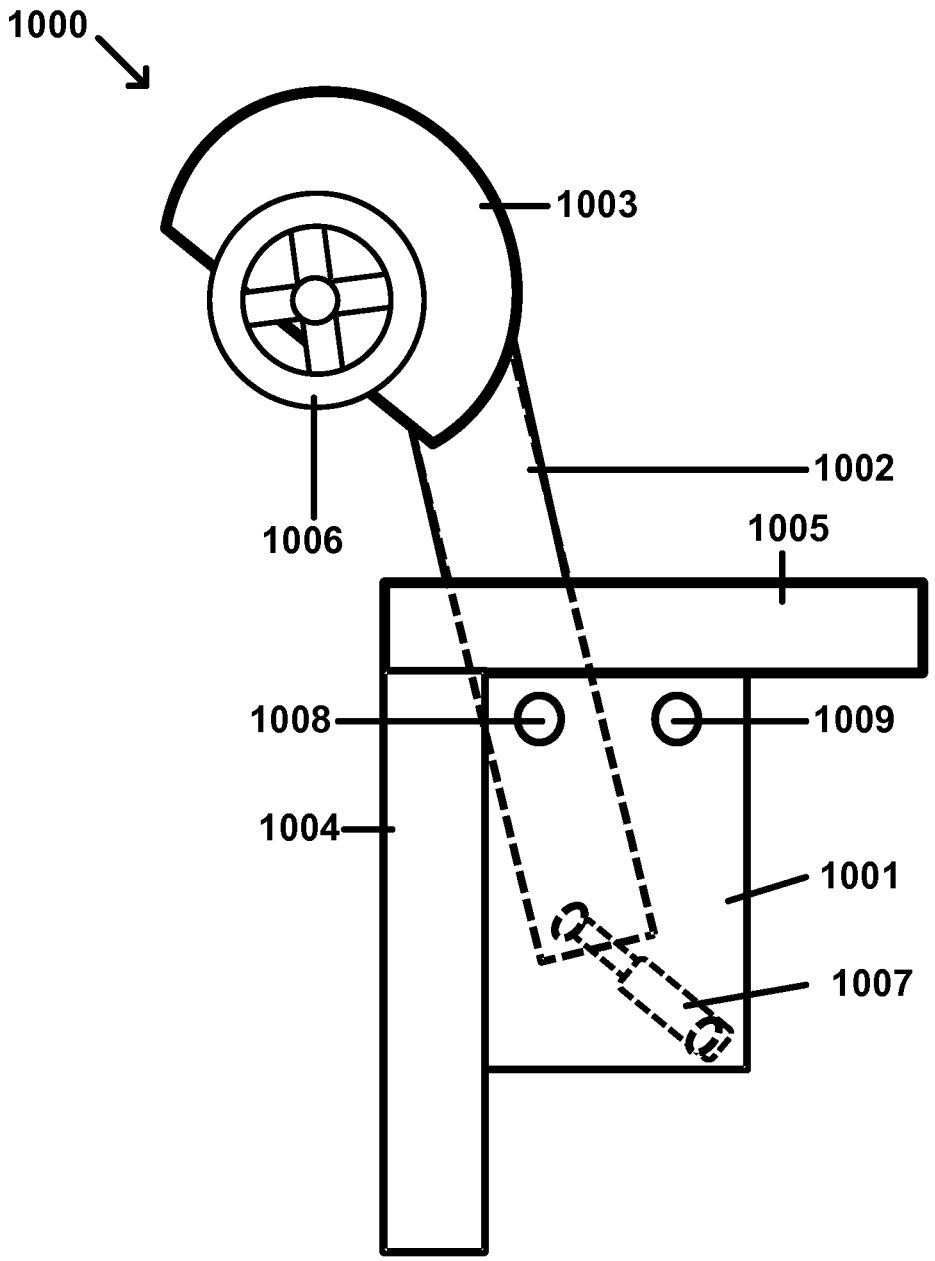
FIG. 10 is a rear-view drawing illustrating an exemplary swing away helm in a watercraft in the non-use position.

FIG. 10 is a rear-view drawing illustrating an exemplary swing away helm 1000 in a watercraft in the non-use position. The swing away helm 1000 includes a mounting member 1001, a support member 1002, and a dashboard 1003. The mounting member 1001 is attached to the exterior side of the molded deck 1004 of the watercraft. The molded deck 1004 also includes a gunnel 1005. The support member 1003 has a proximal end, which fits into the mounting bracket 1001 and a distal end, which is coupled to the dashboard 1003. The support member 1002 is pivotally attached to the mounting member 1001 for pivotal movement about a substantially horizontal axis relative to the gunnel 1005 of the watercraft. The dashboard 1003 includes a steering device 1006. The wiring connecting the dashboard 1003 with the rest of the watercraft is not shown. The biasing member 1007 is attached to the proximal end of the support member 1002 and to the interior surface of the mounting member 1001. The dashboard 1003 and the support member 1002 can swing relative to the mounting member 1001 between a use position (not shown) where the dashboard 1003 extends into the watercraft (not shown) and a non-use position where the dashboard 1003 is positioned above the gunnel 1005. The biasing member 1007 biases the swing away helm 1000 into the use position (not shown) and the non-use position. The mounting member 1001 also included a pivoting member 1008 and a motion limiting member 1009. The pivoting member 1008 allows the support member 1002 to pivot about a substantially horizontal axis relative to the gunnel 1005. The motion limiting member 1008 prevents the swing away helm 1000 from swinging past the use position (not shown) by blocking the upward pivoting movement of the proximal end of the support member 1002 about the pivot member.

Figure 11:
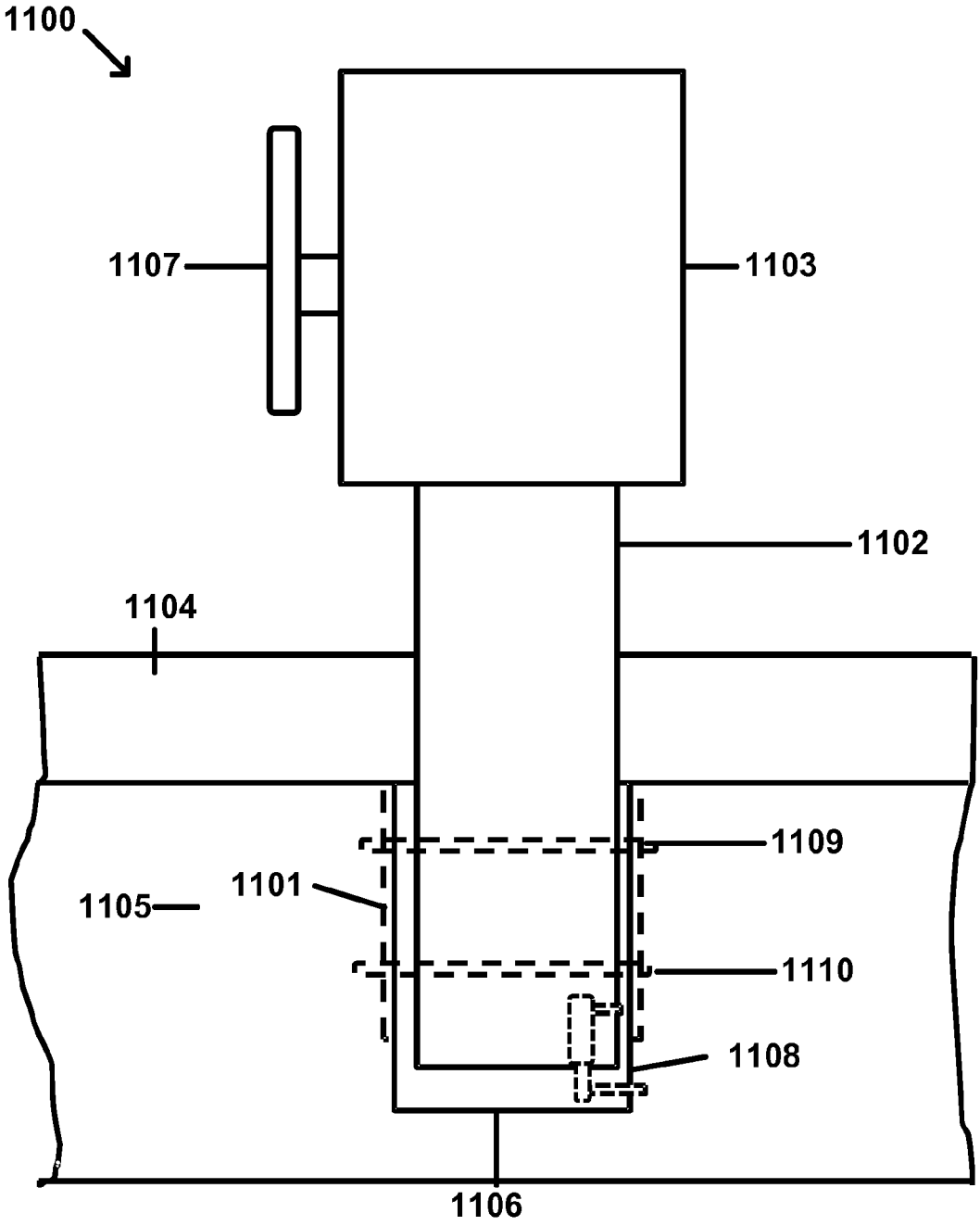
FIG. 11 is a top-view drawing illustrating an exemplary swing away helm in a watercraft in the use position.

FIG. 11 is a top-view drawing illustrating an exemplary swing away helm 1100 in a watercraft in the use position. The swing away helm 1100 includes a mounting member 1101, a support member 1102, and a dashboard 1103. The mounting member 1101 is attached to the exterior side of the molded deck 1104 of the watercraft. The molded deck 1104 also includes a gunnel 1105 and an opening in the gunnel 1106. The support member 1102 has a proximal end, which fits into the mounting bracket 1101 and a distal end, which is coupled to the dashboard 1103. The support member 1102 is pivotally attached to the mounting member 1101 for pivotal movement about a substantially horizontal axis relative to the gunnel 1105 of the watercraft. The dashboard 1103 includes a steering device 1107. The wiring connecting the dashboard 1103 with the rest of the watercraft is not shown. The biasing member 1108 is attached to the proximal end of the support member 1102 and to the interior surface of the mounting member 1101. The dashboard 1103 and the support member 1102 can swing relative to the mounting member 1101 between a use position where the dashboard 1103 extends into the watercraft and a non-use position (not shown) where the dashboard 1103 is positioned above the gunnel 1105. The biasing member 1108 biases the swing away helm 1100 into the use position and the non-use position (not shown). The mounting member 1101 also included a pivoting member 1109 and a motion limiting member 1110. The pivoting member 1109 allows the support member 1102 to pivot about a substantially horizontal axis relative to the gunnel 1105. The motion limiting member 1110 prevents the swing away helm 1100 from swinging past the use position by blocking the upward pivoting movement of the proximal end of the support member 1102 about the pivoting member 1109.

As used herein, except as explicitly required by claim language, a single component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A swing away helm for a watercraft that is positionable between a use position in which the swing away helm extends into the watercraft and a non-use position in which the swing away helm is positioned above a gunnel of the watercraft, the swing away helm comprising:

a mounting member having an interior surface and an exterior surface, wherein the exterior surface of the mounting member is coupled to a first surface on a starboard or a port side of a deck having a first surface and a second surface;

a support member having a proximal end and a distal end, wherein the proximal end of the support member is pivotally attached to the mounting member for pivotal movement about a substantially horizontal axis relative to the gunnel of the watercraft;

a dashboard having a first surface and a second surface, wherein the dashboard is coupled to the distal end of the support member;

a steering device operatively coupled to the first surface of the dashboard;

a biasing member having a proximal end and a distal end, wherein the biasing member comprises a gas strut, wherein the proximal end of the biasing member is coupled to the distal end of the support member and distal end of the biasing member is coupled to the interior surface of the mounting member, wherein the biasing member biases the swing away helm into the use position and the non-use position, and wherein the swing away helm maintains an equal distance from the gunnel in the use position and in the non-use position.

2. A swing away helm for watercraft that is positionable between a use position in which the swing away helm extends into the watercraft and a non-use position in which the swing away helm is positioned above a gunnel of the watercraft, the swing away helm comprising:

a mounting member having an interior surface and an exterior surface, wherein the mounting member comprises a pivot member and a motion limiting member, wherein the exterior surface of the mounting member is coupled to a first surface on a starboard or a port side of a molded deck having a first surface and a second surface;

a support member having a proximal end and a distal end, wherein the proximal end of the support member is pivotally attached to the pivot member for pivotal movement about a substantially horizontal axis relative to the gunnel of the watercraft, wherein the motion limiting member prevents the swing away helm from swinging past the use position by blocking the movement of the support member, wherein the interior surface of the mounting member prevents the swing away helm from swinging past the non-use position by blocking the movement of the support member;

a dashboard having a first surface and a second surface, wherein the dashboard is coupled to the distal end of the support member;

a steering device operatively coupled to the first surface of the dashboard, wherein the steering device comprises a steering wheel;

a biasing member having a proximal end and a distal end, wherein the proximal end of the biasing member is coupled to the distal end of the support member and distal end of the biasing member is coupled to the interior surface of the mounting member, wherein the biasing member biases the swing away helm into the use position and the non-use position, wherein the biasing member comprises a gas strut, and wherein the swing away helm maintains an equal distance from the gunnel in the use position and in the non-use position.

3. The swing away helm of claim 2, wherein the molded deck comprises a molded cockpit.

4. A swing away helm for a watercraft that is positionable between a use position in which the swing away helm extends into a cockpit and a non-use position in which the swing away helm is positioned above a gunnel of the watercraft, the swing away helm comprising:

a mounting member having an interior surface and an exterior surface, wherein the mounting member comprises a pivot member and a motion limiting member, wherein the exterior surface of the mounting member is coupled to a first surface on a starboard or a port side of a molded deck having a first surface and a second surface, wherein the deck comprises a molded cockpit;

a support member having a proximal end and a distal end, wherein the proximal end of the support member is pivotally attached to the pivot member for pivotal movement about a substantially horizontal axis relative to the gunnel of the watercraft, wherein the motion limiting member prevents the swing away helm from swinging past the use position by blocking the movement of the support member, wherein the interior surface of the mounting member prevents the swing away helm from swinging past the non-use position by blocking the movement of the support member;

a dashboard having a first surface and a second surface, wherein the dashboard is coupled to the distal end of the support member;

a steering device operatively coupled to the first surface of the dashboard, wherein the steering device comprises a steering wheel;

a biasing member having a proximal end and a distal end, wherein the proximal end of the biasing member is coupled to the distal end of the support member and distal end of the biasing member is coupled to the interior surface of the mounting member, wherein the biasing member biases the swing away helm into the use position and the non-use position, wherein the biasing member comprises a gas strut, and wherein the swing away helm maintains an equal distance from the gunnel in the use position and in the non-use position.

* * * * *